US011788379B2

(12) United States Patent
Gil et al.

(10) Patent No.: US 11,788,379 B2
(45) Date of Patent: Oct. 17, 2023

(54) GAS VENTING IN SUBTERRANEAN WELLS

(71) Applicant: ODESSA SEPARATOR, INC., Odessa, TX (US)

(72) Inventors: Nicolas Gil, Odessa, TX (US); Daniel L. Culbertson, Odessa, TX (US); Lowell C. Kirkland, Odessa, TX (US); Cavin Bert Frost, Odessa, TX (US); Mark H. Lowe, Odessa, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 0 days.

(21) Appl. No.: 16/941,143

(22) Filed: Jul. 28, 2020

(65) Prior Publication Data

US 2021/0054717 A1 Feb. 25, 2021

Related U.S. Application Data

(60) Provisional application No. 62/890,983, filed on Aug. 23, 2019.

(51) Int. Cl.

| | |
|---|---|
| ***E21B 34/08*** | (2006.01) |
| ***E21B 43/38*** | (2006.01) |
| ***E21B 43/12*** | (2006.01) |

(52) U.S. Cl.

CPC ..... *E21B 34/08* (2013.01); *E21B 43/121* (2013.01); *E21B 43/38* (2013.01); *E21B 2200/06* (2020.05)

(58) Field of Classification Search

CPC ..... E21B 34/08; E21B 32/121; E21B 43/38; E21B 2200/06

See application file for complete search history.

(56) References Cited

U.S. PATENT DOCUMENTS 3,205,955 A * 9/1965 Whittle ..... E21B 21/10 137/515
3,907,046 A * 9/1975 Gaylord ..... E21B 34/142 175/235

(Continued)

OTHER PUBLICATIONS

Amao; Matthew; "Electrical Submersible Pumping (ESP) Systems", Artificial Lift Methods and Surface Operations, dated Mar. 9, 2014, 51 pages.

(Continued)

*Primary Examiner* — Matthew Troutman
*Assistant Examiner* — Douglas S Wood
(74) *Attorney, Agent, or Firm* — Smith IP Services, P.C.

(57) ABSTRACT

A gas vent tool can include a body with a flow passage having upstream and downstream sections, a valve that selectively permits and blocks flow between the upstream section and an exterior of the gas vent tool, and a valve that selectively permits and blocks flow between the upstream and downstream sections. A gas vent system can include a gas vent tool connected longitudinally between an intake tool and a pump, the intake tool being configured to receive formation fluids therein, and the pump being configured to pump the formation fluids to surface. The gas vent tool can include a valve that selectively permits and blocks flow between an interior flow passage and an annulus external to the gas vent tool, and a valve that selectively permits and blocks flow between upper and lower sections of the flow passage.

17 Claims, 3 Drawing Sheets

(56) References Cited

U.S. PATENT DOCUMENTS 3,967,635 A * 7/1976 Sealfon ..... B01F 35/71805 137/512.2
4,030,546 A 6/1977 Rogers et al.
4,036,297 A * 7/1977 Swihart, Sr. ..... E21B 43/121 166/321
4,128,127 A 12/1978 Taylor
5,108,272 A * 4/1992 Brewer ..... E21B 34/12 417/520
5,437,480 A 8/1995 Weil
5,564,501 A * 10/1996 Strattan ..... E21B 34/10 166/324
5,996,712 A 12/1999 Boyd
6,289,990 B1 * 9/2001 Dillon ..... F16K 17/19 166/373
6,378,630 B1 4/2002 Ritorto et al.
6,679,323 B2 1/2004 Vargervik et al.
6,883,550 B2 4/2005 Bekki et al.
7,165,635 B2 1/2007 Kauffman et al.
7,373,988 B2 5/2008 Campbell et al.
RE41,759 E 9/2010 Helms
7,789,432 B2 9/2010 Dohm et al.
8,146,653 B2 4/2012 Naderi
8,281,866 B2 * 10/2012 Tessier ..... E21B 34/08 137/107
8,327,848 B2 * 12/2012 Ho ..... A61M 16/208 128/205.24
8,991,484 B2 3/2015 Riggs
9,181,785 B2 * 11/2015 Lawson ..... F04B 47/06
9,516,988 B2 12/2016 Zhao et al.
9,932,778 B2 4/2018 Obrejanu
10,221,973 B2 3/2019 Roper
10,267,102 B2 4/2019 Howell, Sr. et al.
10,293,891 B2 5/2019 Eide
10,294,732 B2 5/2019 Robichaux et al.
10,781,662 B2 * 9/2020 Andersson ..... E21B 34/08
2007/0235197 A1 * 10/2007 Becker ..... E21B 43/123 166/372
2018/0073308 A1 3/2018 Tran et al.
2018/0216417 A1 8/2018 Escobedo
2019/0218865 A1 7/2019 Horn

OTHER PUBLICATIONS

Petrowiki; "Downhole hydraulic pump installations", online Wikipedia article, dated Feb. 4, 2016, 11 pages.
Petrowiki; "Sucker-rod lift", online Wikipedia article, dated Jan. 19, 2016, 16 pages.

* cited by examiner

GAS VENTING IN SUBTERRANEAN WELLS

CROSS-REFERENCE TO RELATED APPLICATION

This application claims the benefit of the filing date of U.S. provisional application No. 62/890,983 filed on 23 Aug. 2019. The entire disclosure of the prior application is incorporated herein by this reference.

BACKGROUND

This disclosure relates generally to equipment utilized and operations performed in conjunction with a subterranean well and, in an example described below, more particularly provides a gas vent tool, and associated methods and systems.

In a well intended for production of liquids, the production of gas can be undesired, inconvenient, uneconomical and even damaging to well equipment. For example, a pump designed to pump liquids may become inoperative, may pump much less efficiently or may be damaged if the pump is required to pump gas in addition to the liquids.

It will, therefore, be appreciated that improvements are continually needed in the art of venting gas or otherwise preventing the production of gas from a well. The present disclosure provides such improvements to the art.

DETAILED DESCRIPTION

Figure 1:
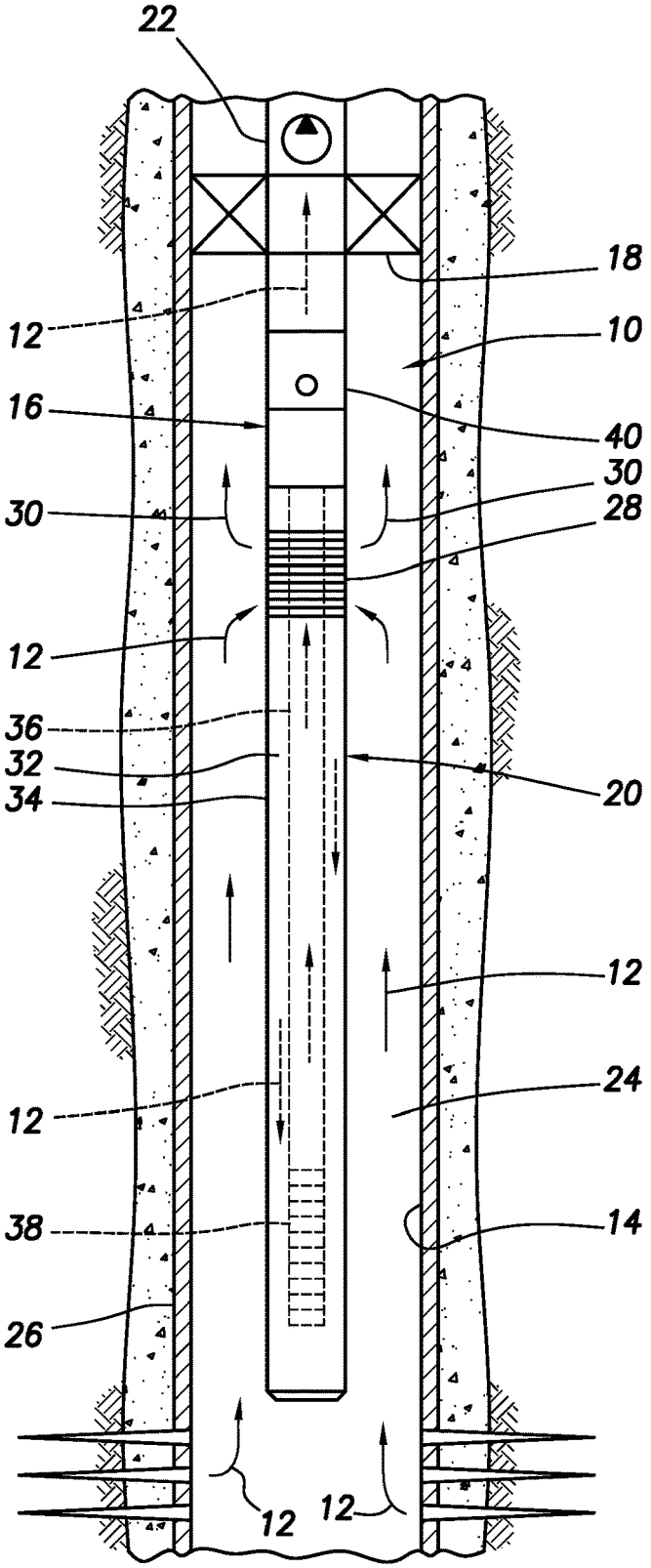
FIG. 1 is a representative partially cross-sectional view of an example of a gas venting system and associated method which can embody principles of this disclosure.

Representatively illustrated in FIGS. 1-3B is a gas vent tool, gas venting system and associated method which can embody principles of this disclosure. However, it should be clearly understood that the gas vent tool, system and method are merely one example of an application of the principles of this disclosure in practice, and a wide variety of other examples are possible. Therefore, the scope of this disclosure is not limited at all to the details of the gas vent tool, system and method described herein and/or depicted in the drawings.

In oil and gas production utilizing artificial lift to bring liquids and gas to the surface, a common issue found in many wells is the problem of separating gas from liquids. Pumps of any type work well in pumping liquids but do not operate well when gas is introduced to the pump. Gas in the system causes pump inefficiency and can introduce fluid pound which can result in premature equipment failure.

In many bottom hole assemblies, gas can become trapped within a dip tube of a gas separator, tubing screen or other intake tool (such as, those that utilize a dip tube), especially when the pump cycles off. The gas vent tool example depicted in the drawings allows gas to continually bleed off so that when the pump begins to operate, no gas is present to be pulled into the pump.

Referring now to FIG. 1, an example of the gas venting system 10 is representatively illustrated. In this example, formation fluids 12 are produced into a wellbore 14. The formation fluids 12 include liquids and gas.

A tubular string 16 is installed in the wellbore 14 to facilitate production of the fluids 12 to surface. The tubular string 16 may be of the type known to those skilled in the art as a completion string or a production string. The tubular string 16 may comprise more than one section (for example, an upper section uphole of a packer 18 could be separately retrievable from a lower section including the packer and components downhole of the packer).

The tubular string 16 may include more components, less components or different combinations of components from those depicted in FIG. 1. Thus, the scope of this disclosure is not limited to any particular configuration or combination of components in the tubular string 16.

In the FIG. 1 example, the tubular string 16 includes an intake tool 20, a gas vent tool 40, the packer 18 and a pump 22. Note that the gas vent tool 40 is connected longitudinally between the intake tool 20 and the pump 22. In other examples, the gas vent tool 40 could be connected between the packer 18 and the pump 22.

As depicted in FIG. 1, the formation fluids 12 enter the wellbore 14 and flow into an annulus 24 formed radially between a casing 26 and the intake tool 20. The casing 26 forms a protective lining for the wellbore 14. In other examples, the intake tool 20 could instead be positioned in an open hole or uncased section of the wellbore 14.

The fluids 12 flow from the annulus 24 into an intake screen 28 of the intake tool 20. In some examples, the intake tool 20 could comprise a sand screen or other types of intake tools. In the FIG. 1 example, the intake tool 20 comprises a gas separator that functions to separate gas 30 from the fluids 12 upstream of the pump 22.

After the fluids 12 enter the intake screen 28, they flow downward through an annulus 32 formed radially between an outer housing 34 and an inner tube 36 of the intake tool 20. As the fluids 12 flow downward through the annulus 32, the gas 30 can separate from the fluids and rise in the annulus 32. This gas 30 can accumulate in an upper section of the annulus 32 and eventually pass out of the intake tool 20 via an upper section of the intake screen 28 as depicted in FIG. 1.

Near a lower section of the annulus 32, the fluids 12 can enter a lower end of the inner tube 36 via a screen 38. The fluids 12 can then flow upwardly through the inner tube 36, the gas vent tool 40, the packer 18 and the pump 22 for production to the surface.

Although the intake tool 20 depicted in FIG. 1 is designed to separate the gas 30 from the formation fluids 12, there can still be some gas remaining in the fluids as they are flowed from the intake tool to the pump 22. In addition, in some cases the intake tool 20 may not be designed to separate any gas 30 from the fluids 12 (for example, if the intake tool consists essentially of one or more sand screens with no gas separation capability).

If the pump 22 is turned off for an extended period of time, the gas 30 can accumulate at an intake of the pump. When the pump 22 is re-started, this accumulated gas 30 can prevent the pump from pumping the fluids 12, can cause the pump to operate much less efficiently, and/or can cause damage to the pump.

However, in the FIG. 1 system 10, the gas vent tool 40 allows gas 30 that has accumulated on the intake side of the pump 22 to be vented to an upper section of the annulus 24 while the pump is not pumping. In this manner, the gas 30 will not be present on the intake side of the pump 22 (or will be significantly reduced in volume), so that the pump can be safely re-started.

Figure 2:
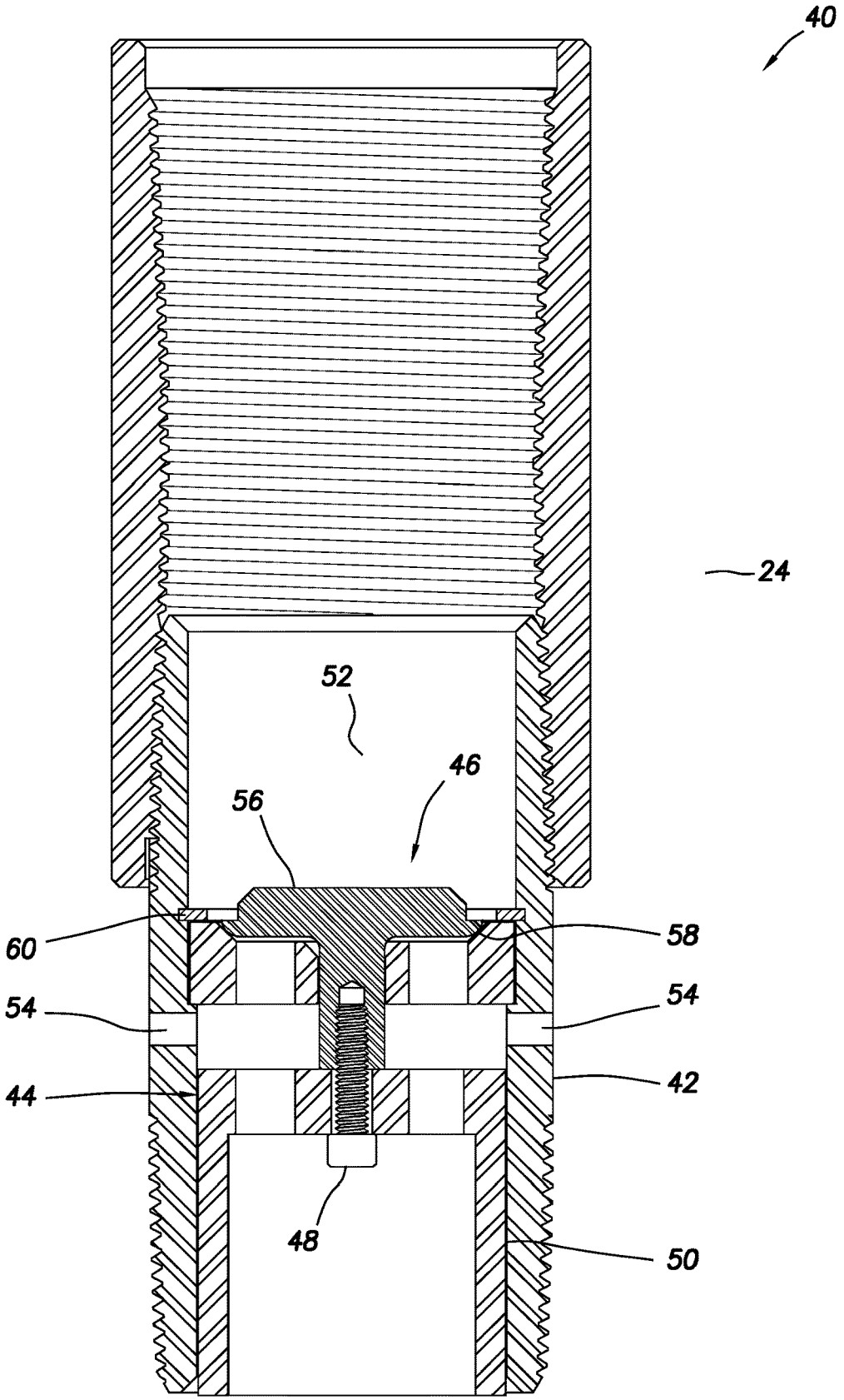
FIG. 2 is a representative cross-sectional view of an example of a gas vent tool which can embody the principles of this disclosure.

Referring additionally now to FIG. 2, a cross-sectional view of an example of the gas vent tool 40 is representatively illustrated. The gas vent tool 40 may be used with the FIG. 1 system 10 and method, or it may be used with other systems and methods.

The gas vent tool 40 example as depicted in the drawings includes a generally tubular gas vent body 42 which is attached using a tubing collar (not shown) above a component of a bottom hole assembly (e.g., a gas separator, tubing screen, another type of intake tool 20, etc.) and below the pump 22. The body 42 is a single component as depicted in FIG. 2, but the body could be made up of multiple components in other examples. The gas vent body 42 contains a gas vent sliding valve 44 which is anchored to a gas vent "T" valve 46 with a cap screw 48.

The sliding valve 44 includes a sliding sleeve 50 reciprocably disposed in a flow passage 52 extending longitudinally through the body 42. In the FIG. 1 system and method, the flow passage 52 extends longitudinally through the tubular string 16 when the gas vent tool 40 is connected in the tubular string.

In a vent configuration of the gas vent tool 40 depicted in FIG. 2, the sleeve 50 does not block flow through ports 54 formed through a wall of the body 42 and providing for fluid communication between the flow passage 52 and an exterior of the gas vent tool 40 (e.g., the annulus 24 in the FIG. 1 system 10). However, if the sleeve 50 is displaced upward, the sleeve will block flow through the ports 54.

The "T" valve 46 is closed in the FIG. 2 vent configuration. In this configuration, the "T" valve 46 blocks flow through the flow passage 52.

The "T" valve 46 opens when a positive pressure differential is applied from below to above the "T" valve, and the sliding valve 44 opens when a positive pressure differential is not applied from below to above the "T" valve. A spring or other type of biasing device could be used to bias the "T" valve 46 toward a closed position, for example, if the gas vent tool 40 is positioned in a non-vertical wellbore or it is desired to not rely on gravity to bias the "T" valve toward the closed position.

The gas vent "T" valve 46 includes a closure member 56 that rests against a valve seat 58 when the pump 22 is cycled off. A snap ring 60 retains the gas vent "T" valve 46 and sliding valve 44 in the gas vent body 42.

Figure 3B:
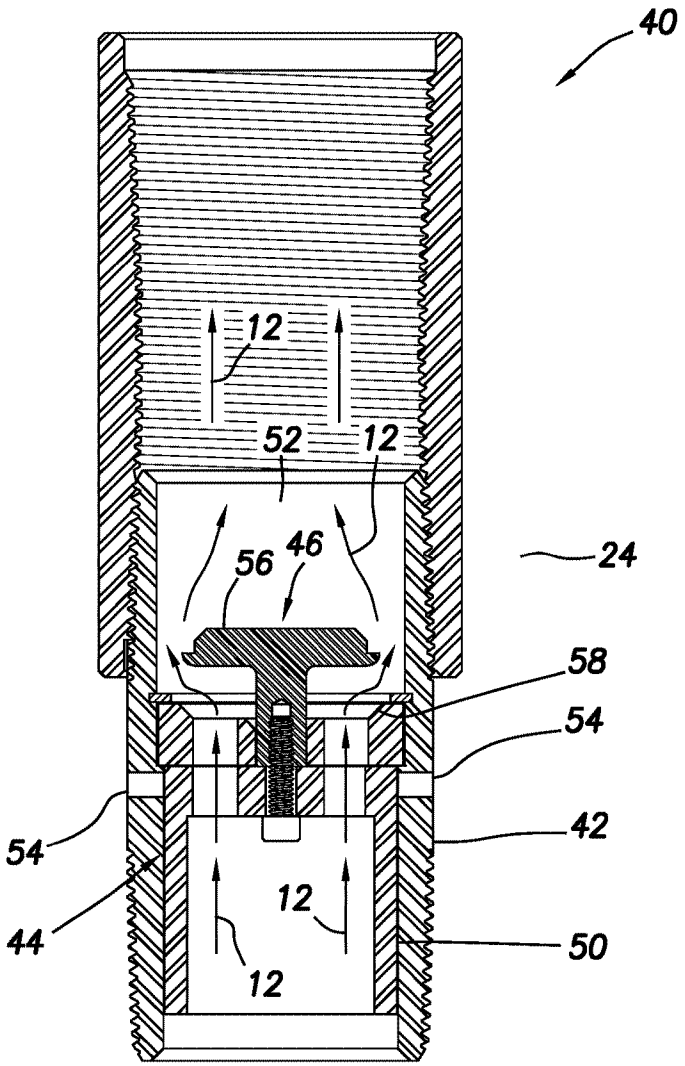
FIGS. 3A & B are representative cross-sectional views of the gas vent tool in respective vent and flow-through configurations.
Figure 3A:
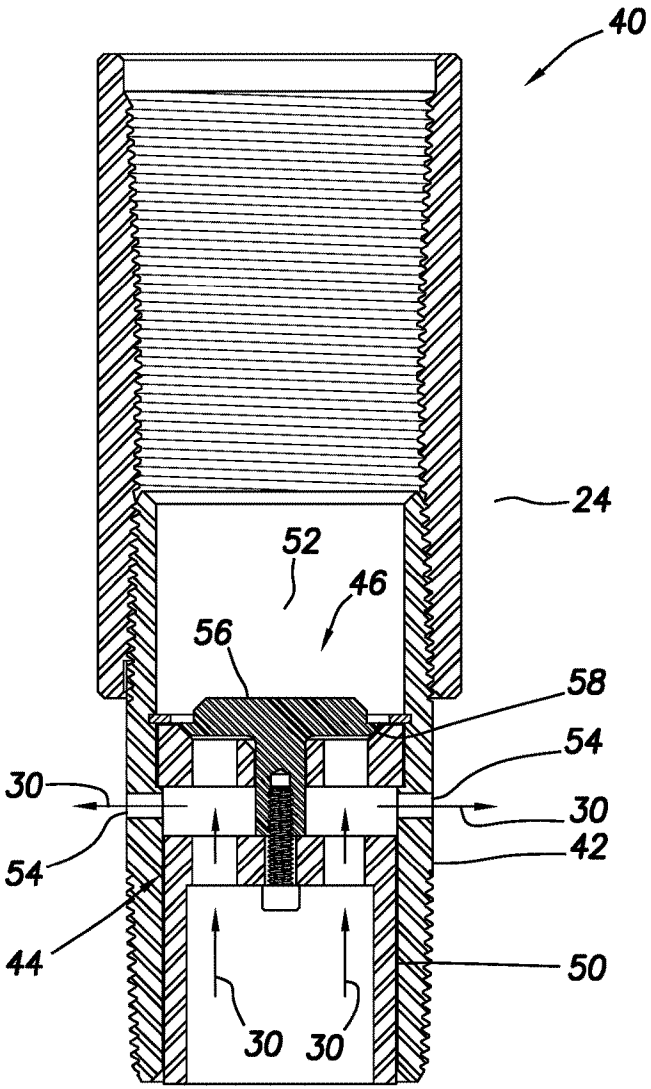

Referring additionally now to FIGS. 3A & B, the gas vent tool 40 is representatively illustrated in the respective vent and flow-through configurations. In the vent configuration of FIG. 3A, the pump 22 is not operating, the sliding valve 44 is open, and the "T" valve 46 is closed. In the flow-through configuration of FIG. 3B, the pump 22 is operating, the sliding valve 44 is closed, and the "T" valve 46 is open.

When the pump 22 cycles off and fluid flow stops, the gas vent tool 40 operates to the vent configuration of FIG. 3A. The sliding sleeve 50 and the closure member 56 displace downward, because there is no longer a positive pressure differential from below to above the closure member 56 when the pump 22 is not operating. Thus, the closure member 56 blocks flow through the flow passage 52, but the sliding sleeve 50 does not block flow through the ports 54.

Gas 30 in the inner tube 36 or other intake tool 20 component is vented out the ports 54 in the gas vent body 42. The gas 30 can flow upward from the flow passage 52 below the valve 46, outward through the ports 54, and to the exterior of the gas vent tool 40 (the annulus 24 in the FIG. 1 system 10).

The gas 30 can rise to an upper section of the annulus 24 below the packer 18. Alternatively, if the gas vent tool 40 is connected above the packer 18, the gas 30 can rise through the annulus 24 above the packer to the surface.

The gas 30 continues to vent to the exterior of the gas vent tool 40 as long as the pump 22 is off, in this example. Once the pump 22 starts up, the gas vent tool 40 operates to the flow-through configuration as depicted in FIG. 3B.

A positive pressure differential from below to above the closure member 56 causes it to displace upward. The sleeve 50 displaces upward with the closure member 56, thereby blocking flow through the ports 54 and permitting flow through the flow passage 52.

In the FIG. 3B flow-through configuration, the closure member 56 is disengaged from the seat 58 and flow of the fluids 12 is permitted from a lower, upstream section to an upper, downstream section of the flow passage 52 (the valve 46 separating the lower and upper sections of the flow passage). The sliding sleeve 50 blocks flow through the ports 54, so that the pump 22 draws the fluids 12 from the flow passage 52 extending downward from the gas vent tool 40 (such as, to the intake tool 20).

If the pump 22 is again stopped, the gas vent tool 40 will revert to the vent configuration of FIG. 3A. Thus, while the pump 22 is stopped, the gas 30 in the lower, upstream section of the flow passage 52 will be vented out to the exterior of the gas vent tool 40, so that the pump will not need to pump the gas when the pump is again started.

It may now be fully appreciated that the above disclosure provides significant advancements to the art of venting gas or otherwise preventing the production of gas from a well. In an example described above, the gas vent tool 40 provides for venting the gas 30 upstream of the pump 22 intake while the pump is stopped. The venting occurs each time the pump 22 is stopped, without a need for human intervention.

The above disclosure provides to the art a gas vent tool 40. In one example, the gas vent tool 40 can comprise: a tubular body 42 with a flow passage 52 extending longitudinally through the body 42, the flow passage 52 having upstream and downstream sections; a first valve 44; and a second valve 46 that selectively permits and blocks flow between the upstream and downstream sections of the flow passage 52. The first valve 44 selectively permits and blocks flow between the upstream section of the flow passage 52 and an exterior of the gas vent tool 40.

The first valve 44 may include a sliding sleeve 50 reciprocably disposed in the body 42. The second valve 46 may include a closure member 56 secured to the sliding sleeve 50.

The second valve 46 may permit flow between the upstream and downstream sections of the flow passage 52 in response to a positive pressure differential from the upstream section to the downstream section. The first valve 44 may block flow between the upstream section of the flow passage 52 and the exterior of the gas vent tool 40 in response to a positive pressure differential from the upstream section to the downstream section.

Another gas vent tool 40 can comprise: a tubular body 42 with ports 54 for fluid communication between an interior and an exterior of the body 42; a seat 58 surrounding an interior flow passage 52 extending longitudinally through the body 42, the seat 58 being positioned on a downstream side of the ports 54; a closure member 56 movable relative to the seat 58 between open and closed positions; and a sliding sleeve 50 reciprocably disposed in the body 42 relative to the ports 54. The sliding sleeve 50 is secured to the closure member 56 so that the sliding sleeve 50 and the closure member 56 displace together.

The closure member 56 may be in the open position when the sliding sleeve 50 blocks flow through the ports 54. The closure member 56 may be in the closed position when the sliding sleeve 50 does not block flow through the ports 54.

The closure member 56 may displace from the closed position to the open position in response to a positive pressure differential from below to above the closure member 56. In the closed position of the closure member 56, the ports 54 may be positioned longitudinally between the seat 58 and the sliding sleeve 50.

A gas vent system 10 for use with a subterranean well is also provided to the art by the above disclosure. In one example, the system 10 can comprise: a gas vent tool 40 connected longitudinally between an intake tool 20 and a pump 22, the intake tool 20 being configured to receive formation fluids 12 therein, and the pump 22 being configured to pump the formation fluids 12 to surface. The gas vent tool 40 comprises first and second valves 44, 46, the first valve 44 selectively permitting and blocking flow between an interior flow passage 52 and an annulus 24 external to the gas vent tool 40, the second valve 46 selectively permitting and blocking flow between upper and lower sections of the flow passage 52.

A sliding sleeve 50 of the first valve 44 may be secured to and displace with a closure member 56 of the second valve 46.

The gas vent tool 40 may have vent and flow-through configurations. In the vent configuration, the first valve 44 is open and the second valve 46 is closed. In the flow-through configuration, the first valve 44 is closed and the second valve 46 is open.

The gas vent tool 40 may be in the flow-through configuration while the pump 22 is operating, and the gas vent tool 40 may be in the vent configuration while the pump 22 is stopped.

In the vent configuration, the first valve 44 may permit flow between the flow passage 52 lower section and the annulus 24, and the second valve 46 may block flow between the flow passage 52 upper and lower sections.

In the flow-through configuration, the first valve 44 may block flow between the flow passage 52 lower section and the annulus 24, and the second valve 46 may permit flow between the flow passage 52 upper and lower sections.

The first valve 44 may include a sleeve 50 reciprocably disposed in a tubular body 42, and the sleeve 50 may block flow through ports 54 in the body 42 in the flow-through configuration. Flow through the ports 54 may be permitted in the vent configuration.

The second valve 46 may include a closure member 56 and a seat 58 surrounding the flow passage 52, and the closure member 56 may permit flow through the seat 58 in the flow-through configuration. The closure member 56 may block flow through the seat 58 in the vent configuration.

The second valve 46 may open in response to a positive pressure differential from below to above the second valve 46. The first valve 44 may close in response to the positive pressure differential from below to above the second valve.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas vent tool, comprising:

a tubular body with a flow passage extending longitudinally through the body, the flow passage having upstream and downstream sections;

a first valve that selectively permits and blocks flow between the upstream section of the flow passage and an exterior of the gas vent tool, in which the first valve comprises a sliding sleeve reciprocably disposed in the body, and in which the first valve blocks the flow between the upstream section of the flow passage and the exterior of the gas vent tool in response to a positive pressure differential from the upstream section to the downstream section; and a second valve that selectively permits and blocks flow between the upstream and downstream sections of the flow passage, in which a closure member of the second valve engages a seat surrounding the flow passage and thereby blocks the flow between the upstream and downstream sections, in which the seat is formed in a seat insert, in which a downstream end of the sliding sleeve abuts the seat insert when the second valve permits the flow between the upstream and downstream sections of the flow passage, and in which the first valve permits the flow between the upstream section of the flow passage and the exterior of the gas vent tool when the second valve blocks the flow between the upstream and downstream sections.

2. The gas vent tool of claim 1, in which the closure member is secured to the sliding sleeve.

3. The gas vent tool of claim 1, in which the second valve permits the flow between the upstream and downstream sections of the flow passage in response to a positive pressure differential from the upstream section to the downstream section.

4. A gas vent tool for use in a subterranean well, the gas vent tool comprising:

a tubular body with ports for fluid communication between an interior and an exterior of the body;

a seat surrounding an interior flow passage extending longitudinally through the body, in which the seat is positioned on a downstream side of the ports;

a closure member movable relative to the seat between open and closed positions, in which the closure member engages the seat and thereby blocks flow through the interior flow passage in the closed position; and a sliding sleeve reciprocably disposed in the body relative to the ports, in which the sliding sleeve is secured to the closure member so that the sliding sleeve and the closure member displace together, in which, in the closed position of the closure member, gas is permitted to flow through at least one passageway in the sliding sleeve and exit the interior flow passage via the ports, in which the closure member displaces from the closed position to the open position in response to a positive pressure differential from below to above the closure member, and in which, in the open position of the closure member, fluid flow exiting the sliding sleeve is longitudinal fluid flow.

5. The gas vent tool of claim 4, in which the closure member is in the open position when the sliding sleeve blocks flow through the ports.

6. The gas vent tool of claim 5, in which the closure member is in the closed position when the sliding sleeve does not block flow through the ports.

7. The gas vent tool of claim 4, in which, in the closed position of the closure member, the ports are positioned longitudinally between the seat and the sliding sleeve.

8. A gas vent system for use with a subterranean well, the system comprising:

a gas vent tool connected longitudinally between an intake tool and a pump, the intake tool being configured to receive formation fluids therein prior to entry of the formation fluids into the pump, and the pump being configured to pump the formation fluids to surface, in which the gas vent tool comprises first and second valves, a sliding sleeve of the first valve selectively permitting and blocking flow between an interior flow passage and an annulus external to the gas vent tool, the second valve selectively permitting and blocking flow between upper and lower sections of the flow passage, in which the second valve comprises a closure member and a seat surrounding the flow passage, in which the closure member is positioned longitudinally between the sliding sleeve and the pump, and in which the closure member engages the seat and thereby blocks the flow between the upper and lower sections, the first valve permitting the flow between the interior flow passage and the annulus when the second valve blocks the flow between the upper and lower sections.

9. The system of claim 8, in which the sliding sleeve of the first valve is secured to and displaces with the closure member of the second valve.

10. The system of claim 8, in which the gas vent tool has vent and flow-through configurations, in the vent configuration the first valve is open and the second valve is closed, in the flow-through configuration the first valve is closed and the second valve is open.

11. The system of claim 10, in which the gas vent tool is in the flow-through configuration while the pump is operating, and the gas vent tool is in the vent configuration while the pump is stopped.

12. The system of claim 10, in which the first valve permits flow between the flow passage lower section and the annulus, and the second valve blocks the flow between the flow passage upper and lower sections, in the vent configuration.

13. The system of claim 12, in which the first valve blocks flow between the flow passage lower section and the annulus, and the second valve permits the flow between the flow passage upper and lower sections, in the flow-through configuration.

14. The system of claim 10, in which the first valve comprises a sleeve reciprocably disposed in a tubular body, the sleeve blocks flow through ports in the body in the flow-through configuration, and flow through the ports is permitted in the vent configuration.

15. The system of claim 10, in which the closure member permits flow through the seat in the flow-through configuration, and the closure member blocks the flow through the seat in the vent configuration.

16. The system of claim 8, in which the second valve opens in response to a positive pressure differential from below to above the second valve.

17. The system of claim 16, in which the first valve closes in response to the positive pressure differential from below to above the second valve.

* * * * *